US006948914B2

(12) United States Patent
Kragelund et al.

(10) Patent No.: US 6,948,914 B2
(45) Date of Patent: Sep. 27, 2005

(54) METERING PUMP WITH AN ELECTRIC MOTOR

(75) Inventors: Bo Kragelund, Skanderborg (DE); Michael Christian Byskov, Skanderborg (DE); Hans Henrik Jochumsen, Allerod (DE)

(73) Assignee: Grundfos A/S, Bjerringbro (DK)

( * ) Notice: Subject to any disclaimer, the term of this patent is extended or adjusted under 35 U.S.C. 154(b) by 105 days.

(21) Appl. No.: 10/333,421

(22) PCT Filed: Jul. 13, 2001

(86) PCT No.: PCT/IB01/01880

§ 371 (c)(1),
(2), (4) Date: Aug. 25, 2003

(87) PCT Pub. No.: WO02/08601

PCT Pub. Date: Jan. 31, 2002

(65) Prior Publication Data

US 2004/0028530 A1 Feb. 12, 2004

(30) Foreign Application Priority Data

Jul. 21, 2000 (DE) ..... 100 35 834

(51) Int. Cl.[7] ..... F04B 49/06; F04B 49/00; F04B 17/00

(52) U.S. Cl. ..... 417/44.1; 417/44.1; 417/300; 417/413.1; 417/278

(58) Field of Search ..... 417/44.1, 300, 417/413.1, 278

(56) References Cited

U.S. PATENT DOCUMENTS

| | | | | |
|---|---|---|---|---|
| 4,389,163 A | * | 6/1983 | Magnussen, Jr. et al. | 417/2 |
| 4,482,346 A | * | 11/1984 | Reinicke | 604/152 |
| 4,624,625 A | | 11/1986 | Schrenker | |
| 5,423,661 A | * | 6/1995 | Gabeler et al. | 417/410.4 |
| 5,707,212 A | * | 1/1998 | Matthews | 417/44.1 |
| 6,095,757 A | * | 8/2000 | Frezza | 417/44.1 |

FOREIGN PATENT DOCUMENTS

| | | |
|---|---|---|
| DE | 2219042 | 10/1973 |
| DE | 19623537 | 12/1997 |

* cited by examiner

*Primary Examiner*—Timothy S. Thorpe
*Assistant Examiner*—C H Orders
(74) *Attorney, Agent, or Firm*—Jacox Meckstroth & Jenkins

(57) ABSTRACT

The metering pump comprises a synchronous motor which is stepped down via a mechanical gear and the rotation movement of the motor is converted into a stroke movement which drives the membrane pump. To the motor there is allocated an electronic control which may be activated by external impulses with regard to the delivery quantity. At the same time the control operates such that one always passes through a complete operating cycle of the pump if the nominal delivery quantity resulting on account of the received impulses is as large or larger than the quantity which the pump delivers in an operating cycle.

13 Claims, 1 Drawing Sheet

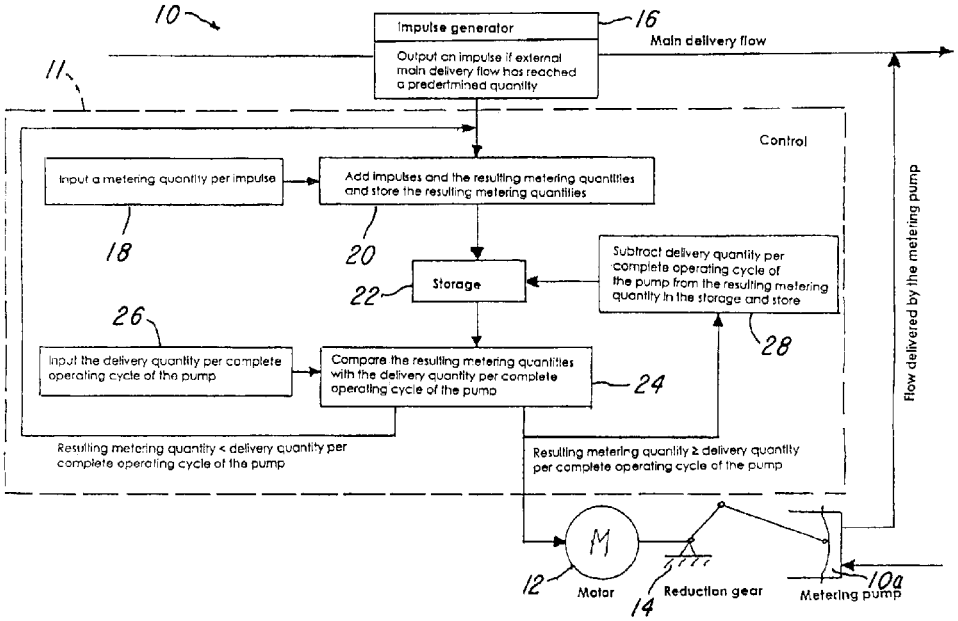

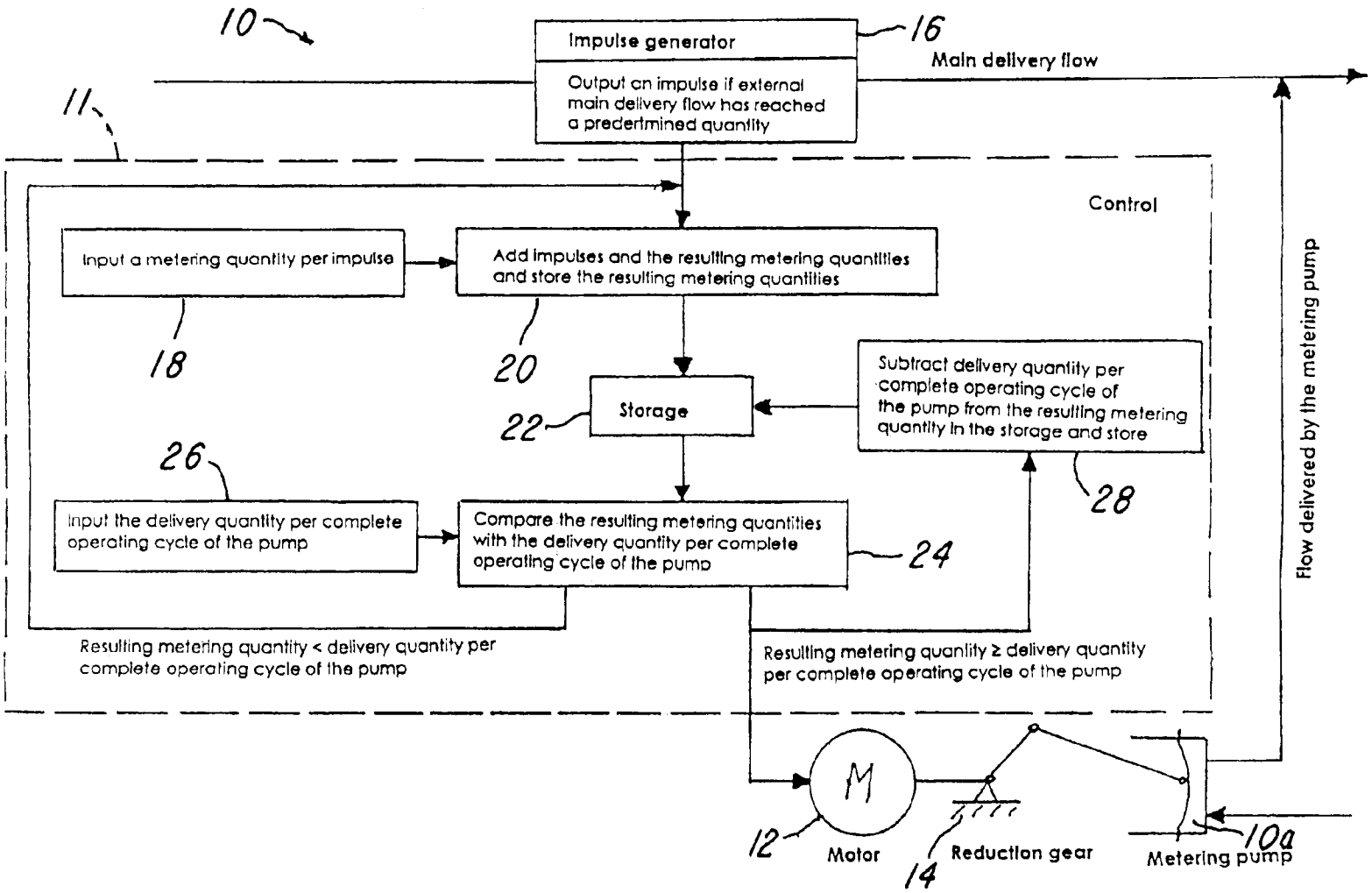
Impulse generator
Output an impulse if external main delivery flow has reached a predetermined quantity
16
Main delivery flow
Flow delivered by the metering pump
10
11
Control
Input a metering quantity per impulse
18
Add impulses and the resulting metering quantities and store the resulting metering quantities
20
Storage
22
Subtract delivery quantity per complete operating cycle of the pump from the resulting metering quantity in the storage and store
28
Input the delivery quantity per complete operating cycle of the pump
26
Compare the resulting metering quantities with the delivery quantity per complete operating cycle of the pump
24
Resulting metering quantity ≥ delivery quantity per complete operating cycle of the pump
Resulting metering quantity < delivery quantity per complete operating cycle of the pump
M
Motor
12
Reduction gear
14
Metering pump
10a

METERING PUMP WITH AN ELECTRIC MOTOR

BACKGROUND OF THE INVENTION

1. Field of the Invention

The invention relates to a metering pump having a synchronous motor that is stepped down via a mechanical gear and the rotating movement of the motor is converted into a stroke movement that drives a membrane pump.

2. Description of the Related Art

With metering pumps, one differentiates essentially between two types of construction, electromagnetically and electromotorically driven ones. With the first construction type, the control of the delivery quantity is effected via the frequency at which the stroke magnet is driven, wherein additionally the stroke volume as a rule may be changed by way of a mechanical setting screw, i.e., the delivery quantity per operating cycle. In contrast, with electromotorically driven metering pumps, such a mechanical stroke adjustment is not regularly provided and it would indeed be technically comparatively complicated. With these pumps, the oscillating movement of the pump is produced by a gear in the manner of a crank mechanism or a suitable block guiding, wherein the rotational movement of the motor is usually stepped down in order to permit a more fine touch control of the pump. With the application of stepper motors the interval between the motor steps for this is accordingly varied. The latter construction type is however relatively expensive on account of the motor and furthermore demands a complicated electronic control.

It is usual to provide an impulse control in order to adapt the flow to be delivered by the metering pump to another delivery flow (main delivery flow) with regard to time and quantity, in order to ensure a predetermined mixing ratio between these flows. For this metering pumps of both construction types usually have an input for an external impulse generator. At the same time a metering quantity to be set previously, i.e. a certain volume to be delivered by the metering pump, is allocated to each impulse of the external impulse generator which emits impulses in temporal intervals according to the throughput quantity of the main delivery flow. Whilst with the initially mentioned metering pumps with an electromagnetic drive this metering quantity to be delivered per impulse is usually set by the mechanical stroke adjustment, with electromotorically driven metering pumps this is exclusively possible by changing the stroke speed, thus the rotational speed of the drive motor.

Stepper motors and servo-motors with the controls necessary for this, as well as electric motors with a controllable rotational speed are comparatively expensive. One therefore makes do without the possibity of external impulse control with metering pumps with an electromotoric drive without rotary speed variation, thus those metering pumps of a simple construction type.

BRIEF SUMMARY OF THE INVENTION

Against this background it is the object of the invention to design a metering pump operated with a drive not speed controllable, and whose stroke volume may not be changed, by way of simple means such that an external control by way of an impulse signal is also possible. In particular it is to be ensured that the delivery or admixing effected by the metering pump in no way exceeds the values predefined by the external control (impulse control).

According to the invention, this object is achieved by a metering pump with an electric motor, with a gearing downstream of this for converting the rotatory rotor movement into a translatory stroke movement, with an oscillating pump driven by this and with an electronic control, wherein the control activates the motor in dependence on an external impulse generator, wherein a predefined metering quantity is allocated to each impulse, and wherein the control activates the motor such that the motor, for passing through a predefined part of an operating cycle of the pump, is only activated when the control has received a number of impulses to which there corresponds a metering quantity which is equal or larger than the delivery quantity which the pump delivers in the predefined part of the operating cycle. Advantageous formations of the invention are specified in the dependent claims as well as in the following description.

The basic concept of the present invention is that firstly a predefined delivery quantity is delivered by the pump when at least that many impulses have been registered by the control such that the metering quantity (nominal metering quantity) resulting from this is equal or larger than the preselected minimum delivery quantity of the pump.

A predefined part of an operating cycle may be selected as long as the metering pump is equipped with a position recognition which permits an allocation of the motor position to the stroke position of the pump, since then the quantity delivered by the pump in this operating cycle is defined. Preferably however the motor is not only activated to pass through a part of the operating cycle but in each case at (east for passing through a complete operating cycle. The delivery quantity is then determined by the stroke volume of the pump. Such a control has the advantage that it may be realized without much technical effort, since with a suitable selection of the applied components one may completely do away with position determination of the motor and/or pump. If the operating cycle has been passed through completely once, at the beginning of the cycle independently of the motor/pump position at all events a complete pump stroke is carried out and thus at least the quantity is approximately delivered which the pump yields on a complete operating stroke. If for example it is the case of a membrane pump, as is usual with such pumps which is in the unloaded middle position when the control of the motor starts, then firstly half an operating stroke is passed, then a complete return stroke and then again the other half of an operating stroke so that in total the delivery quantity of a complete operating stroke is delivered.

The metering pump according to the invention may basically be operated with electric motors of different construction types, for example with a direct current motor or with an asynchronous motor. Advantageously a synchronous motor is applied as an electric motor, since then an electronic switch is sufficient for the motor control, in order to apply a predetermined alternating voltage, preferably the mains voltage, or to disconnect it from this. Since the synchronous motor runs at a constant speed given a predefined mains frequency, this is merely to be switched on for a predefined time in order to pass through a complete operating stroke. Since the gear between the electric motor and pump usually also contains a gear reduction, even with a pure time control one achieves a relatively high accuracy of the metering procedure, even if no position recognition is present.

Since the rotation of the motor is determined by the frequency of the supply voltage, it is particularly favorable not to control this according to a fixed time setting, but according to a predefined number of mains supply periods of the supply voltage. At the same time, one may ensure that a high metering accuracy is effected without position recognition even with frequency fluctuations in the mains supply. Moreover, the motor may be operated at 50 Hz or 60 Hz mains frequency without changes on the control side.

In order to further increase the accuracy of the metering, it is useful to equip the pump in a manner so that it may be calibrated. At the same time the actual quantity delivered by the pump in one operating cycle or where appropriate also part cycle is evaluated and stored in the control.

In the control a predetermined metering quantity (nominal delivery quantity) which preferably may be set on the control side is allocated to each external impulse. Within the control the incoming impulse and the metering quantities in each case resulting from these are added until the sum of the metering quantities has reached a value which is equal or larger than the delivery quantity of the pump in one operating cycle. Then the pump is activated in delivery. In the control one takes account of the quantity which has been delivered by the pump in this operating cycle and accordingly subtracts this from the whole metering quantity. In this manner the remaining rest of the metering quantity is not lost, but is taken into account with regard to quantity. Reversely, in the control one also takes note if the delivery quantity of the pump remains below the metering quantity given by the impulse on account of the motor rotational speed limited by the mains frequency, in order yet to deliver this missed quantity when the temporal intervals of the impulses become larger again.

BRIEF DESCRIPTION OF THE DRAWING

One embodiment of the invention is illustrated in the drawing.

These and other objects and advantages of the invention will be apparent from the following description and appended claims.

DETAILED DESCRIPTION OF THE INVENTION

For a better understanding, the invention is hereinafter described by way of example. A metering pump 10 whose basic construction is for example known from DE 196 23 537 A1, which is incorporated herein by reference and made a part hereof, is driven with a drive motor 12 in the form of a synchronous motor. The motor 12 drives a reduction gear 14 which furthermore converts the rotational movement into a stroke movement which in turn drives the membrane pump 10. The membrane pump 10 delivers 1 ml on a complete pump stroke. One operating cycle of the pump 10 consists of a return stroke with which the membrane pump 10 suctions fluid into the pump chamber 10*a* and a working stroke with which the fluid located in the pump chamber 10*a* is expelled under pressure. Since the gear 14 is of a mechanical positive fit, a defined part stroke is allocated to each rotation of the motor 12. An operating cycle of the pump 10 (return stroke and working stroke) thus corresponds to a number of motor revolutions predetermined by the mechanics. The synchronous motor 12 which selectively may be operated at 50, 60 or even another mains frequency, comprises a control 11 which determines an operating cycle of the pump 10 by way of mains supply periods which have been supplied to the motor 12 (i.e., in which the motor was conductingly connected to the mains supply). A defined rotational angle of the motor 12 is allocated to each mains period and thus on account of the motor data and the known mechanical gearing ratios, without further ado one may determine how many mains periods are required so that the pump 10 passes through a complete operating cycle. One therefore requires no position recognition for the pump 10 or the motor 12 since on passing through the complete operating cycle a quantity of 1 ml is always delivered. This quantity is evaluated previously by calibration and is inputted to the control.

If now this metering pump 10 is to admix into a changing main delivery flow, then a synchronisation of the delivery quantities is required. For this one usually provides an impulse generator 16 in the external main delivery flow which always outputs an impulse when the external main delivery flow has reached a predetermined quantity so that the metering pump 10 delivers a suitable metering quantity, i.e. admixes to this main delivery flow. In the present example the metering quantity to be dispensed per impulse should be 0.3 ml.

If thus at the beginning of the delivery the control obtains the first external impulse, firstly a metering quantity (nominal delivery quantity) of 0.3 ml is stored in the motor control (blocks 18–22 of the Drawing). It may then be checked (block 24) whether the storage (block 22) content corresponds to the quantity of 1 ml delivered by the pump in one operating cycle (block 26) is larger. If this is not the case as in the previous example, then the metering quantity remains in the storage as a nominal delivery quantity.

On receipt of the next impulse firstly the metering quantity in the storage is increased by 0.3 ml, whereupon again it is compared (block 24) as to whether the then resulting metering quantity of 0.6 ml is larger than or equal to the quantity of 1 ml delivered by the pump in one operating cycle. This is not the case so that the metering quantity remains in the storage (block 22).

When the fourth impulse is received the metering quantity in the storage has risen to 1.2 ml. Since this quantity is larger than the quantity of 1 ml delivered by the pump 10 in one operating cycle, then the electric motor 12 is activated by the control for the number of mains periods which corresponds to a complete operating cycle of the pump 10. Then the storage content is reduced by the delivered quantity of 1 ml so that there remains a metering quantity of 0.2 ml which then is taken into account as well on receipt of the following impulse (block 28 in the Drawing).

In this manner even with a simply constructed delivery pump 10 (with synchronous motor and less complex motor control) one may effect a comparatively exact metering, in particular an adaptation to an external delivery flow.

While the form of apparatus herein described constitute a preferred embodiment of this invention, it is to be understood that the invention is not limited to this precise form of apparatus, and that changes may be made therein without departing from the scope of the invention which is defined in the appended claims.

What is claimed is:

1. A metering pump with an electric motor, with an oscillating pump, and gearing for coupling said electric motor to said oscillating pump for converting a rotatory rotor movement of the motor into a translatory stroke movement of the oscillating pump, with said oscillating pump being driven by said electric motor having an electronic control, wherein said electronic control activates the electric motor in dependence on an external impulse generator, wherein a predefined metering quantity is allocated to each impulse, and wherein said electronic control activates the motor such that the electric motor, for passing through a predefined part of an operating cycle of the oscillating pump, is only activated when said electronic control has received a number of impulses to which there corresponds said metering quantity which is equal or larger than a delivery quantity which said oscillating pump delivers in the predefined part of said operating cycle.

2. The metering pump according to claim 1, wherein the said electronic control evaluates said metering quantity according to received impulses, and from this subtracts the already delivered quantity in order to determine the quantity yet to be delivered, and where appropriate to activate said electric motor in delivery.

3. The metering pump according to claim 1, wherein the delivery quantity of said oscillating pump may be calibrated in that the quantity delivered by said oscillating pump per said operating cycle or part cycle is evaluated and stored in said electronic control.

4. The metering pump according to claim 1, wherein said electric motor is a synchronous motor.

5. The metering pump according to claim 4, wherein the delivery quantity of the oscillating pump is calibrated in that the quantity delivered by the oscillating pump per said operating cycle or part cycle is evaluated and stored in the electronic control.

6. A metering pump with an electric motor, an oscillating pump, and with a gearing for coupling said electric motor to said oscillating pump for converting a rotatory rotor movement of the metering pump into a translatory stroke movement, with said oscillating pump being driven by said electric motor having an electronic control, wherein said electronic control activates said electric motor in dependence on an external impulse generator, wherein a predefined metering quantity is allocated to each impulse, and wherein said electronic control activates the motor such that the electric motor, for passing through a predefined cart of an operating cycle of the oscillating pump, is only activated when said electronic control has received a number of impulses to which there corresponds said metering quantity which is equal or larger than a delivery quantity which said oscillating pump delivers in the predefined part of said operating cycle, wherein said electronic control activates the electric motor for passing through a complete said operating cycle of the oscillating pump when it has obtained a number of impulses to which there corresponds said metering quantity which is equal or larger than the quantity delivered by said oscillating pump in one said operating cycle.

7. The metering pump according to claim 6, wherein the operating cycle is determined by way of the mains periods of the supply voltage of said electric motor.

8. The metering pump according to claim 6, wherein the delivery quantity of the oscillating pump is calibrated in that the quantity delivered by the pump per said operating cycle or part cycle is evaluated and store in said electronic control.

9. The metering pump according to claim 6, wherein said electric motor is a synchronous motor.

10. A metering pump with an electric motor, an oscillating pump, and gearing for coupling said electric motor to said oscillating pump for converting a rotatory rotor movement of the metering pump into a translatory stroke movement, with said oscillating pump being driven by said electric motor having an electronic control, wherein said electronic control activates said electric motor in dependence on an external impulse generator, wherein a predefined metering quantity is allocated to each impulse, and wherein said electronic control activates the motor such that the electric motor, for passing through a predefined part of an operating cycle of the oscillating pump, is only activated when said electronic control has received a number of impulses to which there corresponds said metering quantity which is equal or larger than a delivery quantity which said oscillating pump delivers in the predefined part of said operating cycle wherein said operating cycle is determined by way of the mains periods of the supply voltage of said electric motor.

11. The metering pump according to claim 10, wherein the delivery quantity of said oscillating pump is calibrated in that the quantity delivered by said oscillating pump per said operating cycle or part cycle is evaluated and stored in said electronic control.

12. A metering pump with an electric motor, an oscillating pump and gearing for coupling said electric motor to an oscillating pump for converting a rotatory rotor movement of the metering pump into a translatory stroke movement with said oscillating pump being driven by said electric motor having an electronic control, wherein said electronic control activates the electric motor in dependence on an external impulse generator, wherein a predefined metering quantity is allocated to each impulse, and wherein said electronic control activates the motor such that the electric motor, for passing through a predefined part of an operating cycle of the oscillating pump, is only activated when said electronic control has received a number of impulses to which there corresponds said metering quantity which is equal or lamer than a delivery quantity which the oscillating pump delivers in the predefined part of the operating cycle wherein said electric motor is a synchronous motor; and wherein the operating cycle is determined by way of the mains periods of the supply voltage of said electric motor.

13. The metering pump according to claim 12, wherein the delivery quantity of the pump is calibrated in that the quantity delivered by the oscillating pump per said operating cycle or part cycle is evaluated and stored in the control.

* * * * *